United States Patent [19]

Sippel et al.

[11] Patent Number: 5,033,388

[45] Date of Patent: Jul. 23, 1991

[54] PROJECTILE BASE FOR CARRIER PROJECTILES

[75] Inventors: Achim Sippel; Heinz-Josef Kruse, both of Ratingen; Klaus D. Karius, Jüchen; Michael Primus, Ratingen, all of Fed. Rep. of Germany

[73] Assignee: Rheinmetall GmbH, Düsseldorf, Fed. Rep. of Germany

[21] Appl. No.: 469,590

[22] PCT Filed: May 26, 1989

[86] PCT No.: PCT/EP89/00584

§ 371 Date: Mar. 22, 1990

§ 102(e) Date: Mar. 22, 1990

[87] PCT Pub. No.: WO90/02308

PCT Pub. Date: Mar. 8, 1990

[30] Foreign Application Priority Data

Aug. 16, 1988 [DE] Fed. Rep. of Germany ..... 3827763

[51] Int. Cl.[5] ..... F42B 12/62

[52] U.S. Cl. ..... 102/489; 102/357; 102/473; 102/517; 102/524

[58] Field of Search ..... 102/340, 342, 351, 357, 102/354, 473, 476, 489, 517, 518, 519, 524, 526, 527

[56] References Cited

U.S. PATENT DOCUMENTS

| | | | |
|---|---|---|---|
| 2,507,878 | 5/1950 | Banning . | |
| 4,327,643 | 5/1982 | Barrios . | |

FOREIGN PATENT DOCUMENTS

| | | | |
|---|---|---|---|
| 327681 | 8/1989 | European Pat. Off. | 102/473 |
| 252940 | 5/1911 | Fed. Rep. of Germany . | |
| 2308428 | 8/1974 | Fed. Rep. of Germany | 102/518 |
| 3643291 | 9/1988 | Fed. Rep. of Germany . | |
| 3706033 | 9/1988 | Fed. Rep. of Germany | 102/354 |
| 2037317 | 12/1970 | France . | |

*Primary Examiner*—Harold J. Tudor

*Attorney, Agent, or Firm*—Spencer & Frank

[57] ABSTRACT

In projectile bases (20) for carrier projectiles which are equipped with a cavity (26) on the side facing away from the projectile tail for, for example, a parachute, it may happen that the base plate (23) is axially bent through during firing. This causes the base body (22) to be radially constricted and contact is lost between the rotating band (27) disposed on the body (22) and the gun tube, frequently resulting in a gas breakthrough. To avoid the above-mentioned radial constriction in the region of the rotating band, the projectile base (20) is provided with a base plate (23) which is curved toward the tail of the projectile. The curved configuration of the base plate (23) makes it possible to produce radial widening in the rear projectile base region during firing so as to ensure gas tightness and spin transmission from the rotating band (27) even at high gas pressures.

9 Claims, 4 Drawing Sheets

PROJECTILE BASE FOR CARRIER PROJECTILES

BACKGROUND OF THE INVENTION

The invention relates to a projectile base for carrier projectiles carrying submunition, with the projectile base including a base body having a front section with a cylindrical outer surface, a tail section with a conically tapered outer surface and a base plate, a rotating band disposed on the cylindrical outer surface portion of the base body, and respective cavities disposed in the respective ends of the base body with the base plate therebetween.

Such a projectile base is disclosed, for example in German patent DE No. 3,643,291. As tests have shown, such bases exhibit an unfavorable deformation behavior. This leads to problems in sealing and in the transmission of spin by the rotating band. The gas breakthrough that is unavoidable at high gas pressures (loss of contact between rotating band and tube wall) leads to continuous opening and closing of the sealing gap during passage through the tube and thus to the excitation of oscillations of the projectiles resulting in increased tube wear.

The cause of these sealing problems is that the axial force components acting on the tail of the projectile during firing cause the base plate to be axially bent, and is associated with radial widening of the front projectile base body and radial constriction of the rear projectile base and the rear rotating band region. The radial deformation by the axial force components during firing is superposed on the radial deformations due to the simultaneously acting radial force components. This superposition is the cause of the resulting radial deformation of the projectile base.

The radially acting forces result, on the one hand, from the gas pressure which extends to the rear end of the rotating band and from the rotating band pressure. These forces lead to radial constriction of the base body over its entire length. If, the superposition of both deformation states results in radial constriction at the rear edge of the rotating band, there will be loss of contact between the rotating band and the tube. This exposed gap area fills with gas which is equivalent to an increase in the radial force acting on the base body. The result is further enlargement of the radial constriction in the rotating band region and finally a complete gas breakthrough.

Furthermore, U.S. Pat. No. 4,327,643 discloses explosive projectiles whose base plates are curved at the tail end. However, the interior of the projectiles is filled with an explosive so that the base plate cannot be deformed much in the axial and radial directions (if a cavity were present in the interior of these projectiles, the projectile base, due to its thin walls and the extreme curvature of its base and absent the radial support by the explosive, would collapse under the gas pressure existing up to the rotating band during firing).

SUMMARY OF THE INVENTION

It is the object of the present invention to provide a projectile base of the above mentioned type in which radial constriction in the region of the rotating band is avoided.

This is accomplished according to the invention by providing the surface of the base plate which faces the tail of the base with a curvature such that this surface is curved and tapers rearwardly toward the projectile tail.

The invention is thus based on the idea that the deformation behavior during firing can be corrected by giving the base a curved configuration in that then the axial curvature of the base causes radial widening also in the rear projectile base region. This form-specific base deformation during firing ensures gas tightness and spin transmission from the rotating band even under high gas pressures.

U.S. Pat. No. 4,327,643 does not disclose the idea significant for the above-mentioned invention. In that reference, a corresponding radial constriction of the rotating band is not to be prevented and does not occur at all because the projectile itself is filled with explosive down to the base plate.

Details and advantages of the invention will be described below in connection with embodiments and with the aid of the drawing figures.

DETAILED DESCRIPTION OF THE PREFERRED EMBODIMENT

Figure 1A:
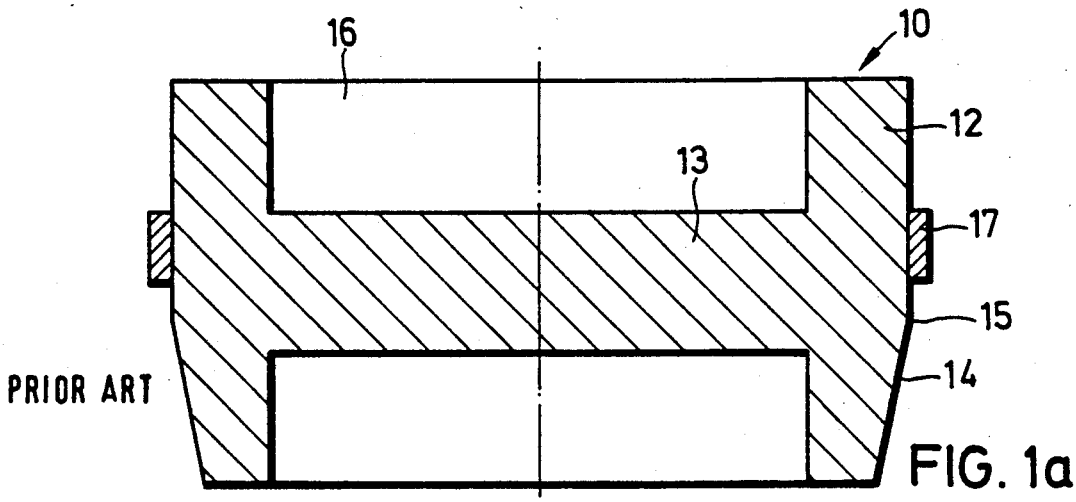
FIGS. 1*a* and 1*b* are schematic representations, in cross section, of a prior art hollow base at rest and during firing.
Figure 1B:
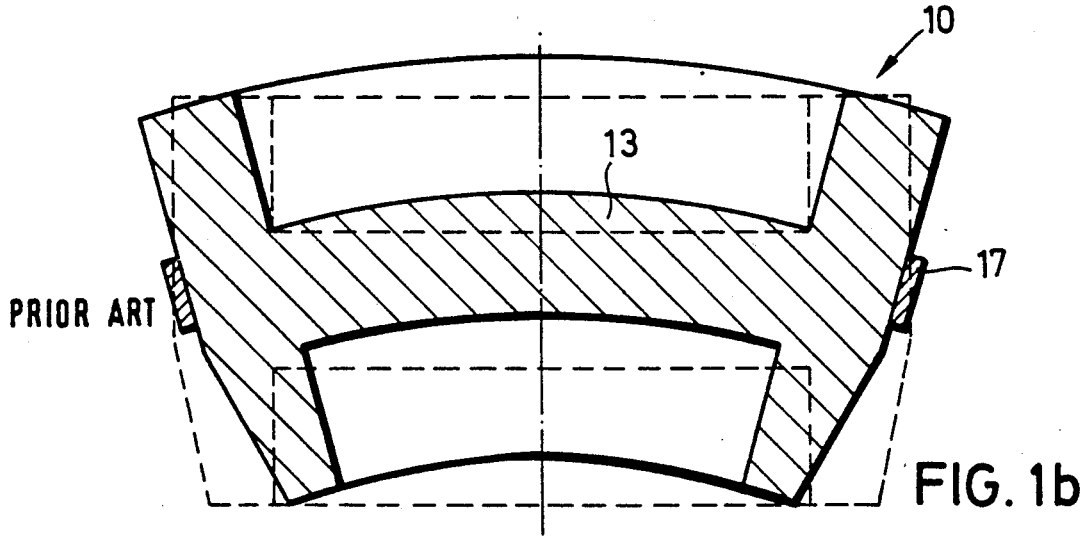

In FIGS. 1*a* and 1*b*, the reference numeral 10 identifies a carrier projectile hollow cylindrical base composed of a base body 12 having a transversely extending base plate 13 formed therein. Base body 12 includes a hollow tail section 14 with an inwardly conically tapered outer surface (also called a boat tail). The reference numeral 15 identifies the upper circumferential edge of the tapered surface of the taper of boat tail 14, i.e. the transition region between the conical tail section 14 and the cylindrical outer surface of base body 12.

On the side of projectile base 10 facing away from the tail of the projectile, there is provided an axial cavity 16 in which there are no components to axially support base plate 13 or to radially support the base body 12. In practice, the parachutes for submunition projectiles disposed in the carrier projectile are often accommodated in this cavity area 16. In a conventional manner a rotating band 17 is applied to the outer cylindrical surface of the base body 12. For reasons of clarity, the tube walls of the weapon which contact the band 17 for firing have not been included in the drawing figures.

In FIG. 1*a*, the projectile base 10 is shown in its rest position. As shown in FIG. 1*b*, the forces acting on the projectile tail during firing cause base plate 13 to be axially bent, this condition being associated with radial widening in the front region of base body 12. At the same time, the tail region of base body 12 is radially constricted, supported by the pressure from the rotating band 17 and the radially acting gas pressure which is present up to the rear edge of the rotating band 17. This constriction has the result that at high gas pressures rotating band 17 loses its sealing function relative to the combustion gases from firing. Once contact with the rear edge of the rotating band 17 has been lost, the effect of the radial force is augmented and the radial constriction of base body 12 increases. A gas breakthrough is then unavoidable.

Figure 2:
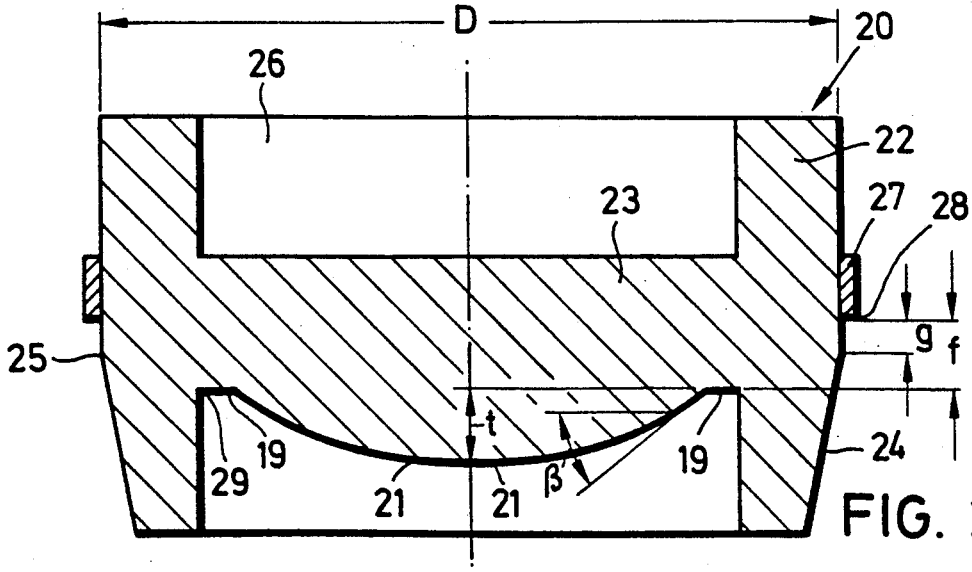
FIG. 2 is a schematic cross-sectional view of a hollow base according to the invention.

FIG. 2 is a cross-sectional view of a projectile base 20 according to the invention which includes a base body 22 having a base plate 23. The projectile base 20 includes a conical tail section 24, circumferential boat tail edge 25, a cavity accommodating the parachute 26 and a rotating band 27. The rear edge of the rotating band 27 is given the reference numeral 28. The base of FIG. 2 is similar to that of FIG. 1*a* with the exception that the rear surface of the base plate 23, i.e., the surface facing the tail of the base, is curved so that it tapers toward the tail and as shown has a convex portion 21 with an outer perimeter portion or edge region 19. The following relationships apply for the rearward curvature of base plate 23:

$$1/20D \leqq t \leqq 1/5D$$

$$1/20D \leqq f \leqq 1/5D$$

$$g \geqq 0$$

$$10° \leqq \beta \leqq 40° \quad (1)$$

where

D=caliber of the projectile t=depth of curvature of the convex portion 21 relative to the outer perimeter portion 19, taken in the axial direction f=axial distance between the rear edge 28 of the rotating-band 27 and the outer edge of the curvature g=distance axial between the rear edge of the rotating band 27 and the upper edge of the boat tail 24

$\beta$=maximum pitch angle.

The radial distance between the edge of the convex portion 21 and the inner edge 29 of the boat tail 24; i.e., the width of region 19, is substantially smaller than the caliber D and essentially corresponds to the transition radii between the curved portion 21 and the inner surface of the boat tail 24. In the following FIGS. 3 to 6, this region 19 is omitted, i.e. the curvature directly follows the inner boat tail edge 29.

A projectile base 30 will now be described in greater detail in which a curved portion 31 of a base plate 33 has the shape of a spherical cap.

Figure 3A:
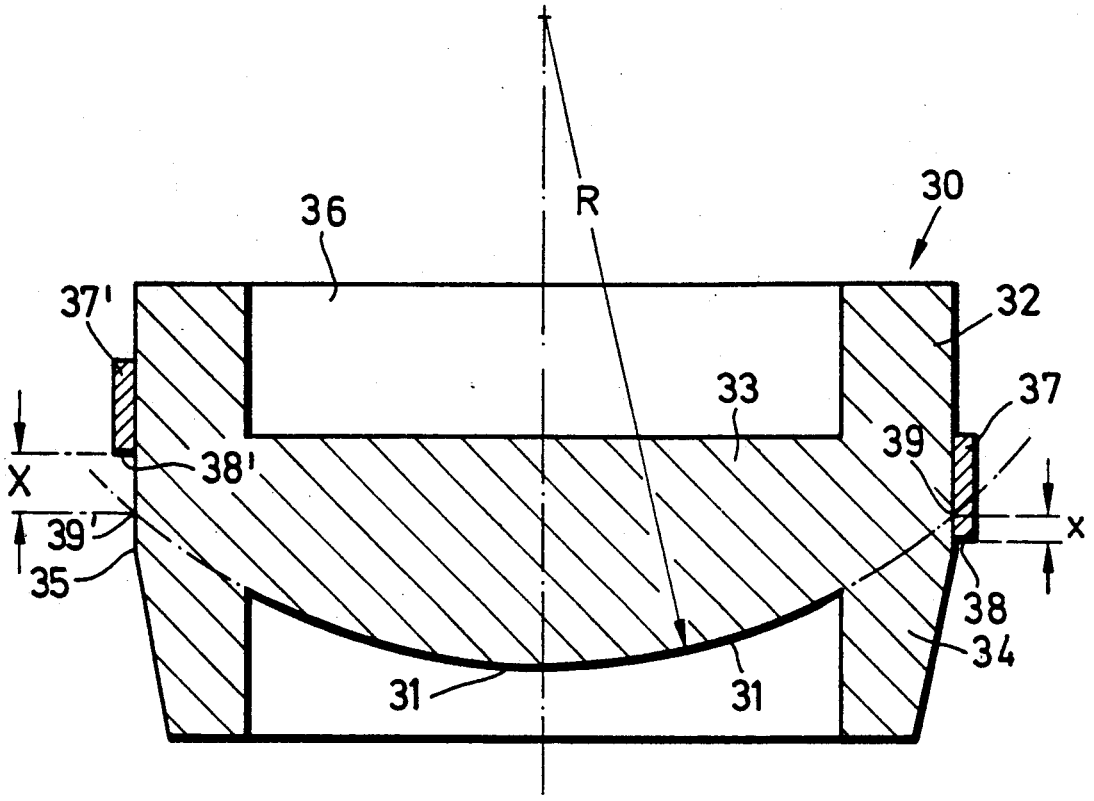
FIGS. 3*a* and 3*b*, cross-sectional views of a spherical cap base according to the invention at rest and during firing.

FIG. 3*a* shows the projectile base 30 according to the invention in its rest state. The projectile base 30 has a base body 32, with a base plate having a spherical cap 31 for a rear surface, and a conical tail section or boat tail 34. The boat tail 34 has a circumferential edge 35. The parachute cavity, the rotating band and the rear edge of the rotating band are given the reference numerals 36, 37 and 37', 38 and 38' respectively. Instead of Relationship (1), the curvature the convex portion or spherical cap 31 of the base plate 33 can also be described with the aid of the following relationship:

$$2/3D \leqq R \leqq 3/2D \quad (2)$$

where R is the radius of the spherical cap 31.

It must additionally be considered that the following should apply for a distance x between the point of intersection 39 of a mathematically defined sphere which contains the outer surface of the extended spherical cap 31 with the outer cylindrical surface of the body 32 and the rear edge 38 or 38', respectively, of the rotating band bands 37 or 37'.

$$x \leqq 1/10D \quad (3)$$

The point of intersection 39 may here lie in front of or behind the rotating band rear edges 38 and 38', respectively. In FIG. 3*a*, the right half of the projectile base 30 shows an embodiment in which the rotating band edge 38 lies behind the point of intersection 39, while the left half of the projectile base 30 shows an embodiment in which the rotating band rear edge 38' lies in front of the point of intersection 39'.

In any case, in all embodiments, rotating band rear edges 38 and 38', respectively, must lie in front of the circumferential edge 35 of the boat tail 34 when seen in the direction of flight ($g \geqq 0$).

Figure 3B:
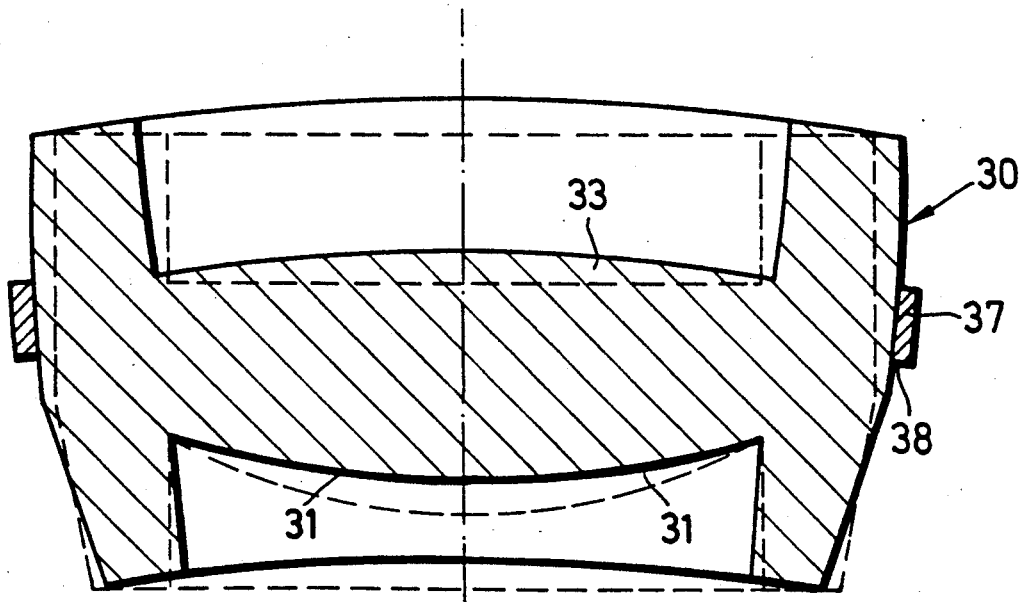

The effect of the curved base plate 33 during firing is shown in FIG. 3*b*. Except for part of the conical tail 34, base body 32 is radially widened. This ensures gas tightness during firing and also for the transmission of spin from rotating band 37 or 37', respectively.

Figures 4A, 4B:
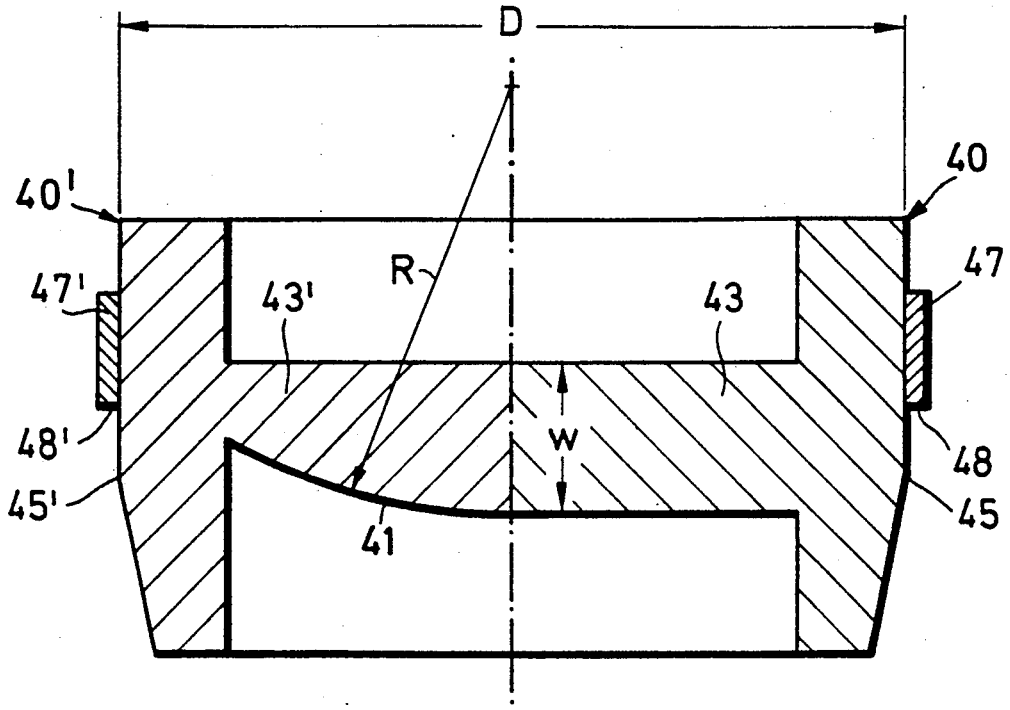
FIGS. 4*a* and 4*b* show a comparison between a prior art flat base with a spherical cap base.

FIG. 4 shows the relationships between a projectile base 40' having a base plate 43' with a spherical cap or convex portion 41 according to the invention (FIG. 4*a*) and of a conventional flat base 40 having a flat base plate 43 (FIG. 4*b*). In both cases, a projectile is involved which has a caliber D=155 mm. The length of the projectile bases 40 and 40', position and length of rotating bands 47 and 47', respectively, are identical. The wall thickness W of the flat base plate 43 is equal to the greatest wall thickness of the spherical cap base plate 43 and is 30 mm. The radius R equals 130 mm. For the flat base 40 the first gas breakthrough occurred at a pressure of 3600 bar, while for the spherical cap base 40' gas breakthrough did not occur until a pressure of 4500 bar.

Figure 5:
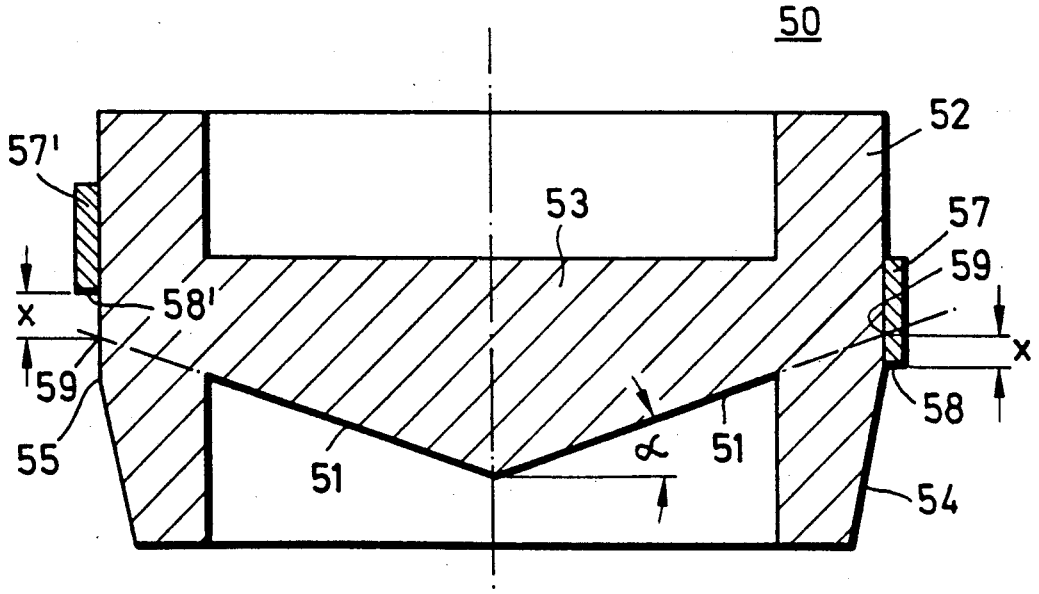
FIG. 5 is a schematic cross-sectional view of the conical base according to the invention.

FIG. 5 shows as a further example a projectile base 50 according to the invention having a base plate 53. The base plate has a curved rear surface 51 which extends toward the tail of the projectile base with a conical taper. The projectile base 50' has a base body 52, and a conical tail section or boat tail 54 with a circumferential edge 55. similar to FIGS. 3*a* and 3*b*, respective points of intersection 59 and 59' of an extension of the conical surface 51 with the cylindrical outer surface of the base body 52 may lie in front of or behind the rear edge 58 or 58', respectively.

The following relationship applies for the cone angle $\alpha$ of the base plate 53:

$$7° \leqq \alpha \leqq 25°$$

Relationship (3) again applies for the distance x between the rear edge 58 or 58' of the rotating band and the point of intersection 59 or 59' respectively.

The present invention is particularly advantageous for artillery carrier projectiles having a thin-walled projectile body. The requirement for maximum length of the useful space limits the height of the base, and the thin walls of the projectile body require that it be radially supported by the base body in the region of the rotating band.

Due to the limited base length, it is thus generally necessary to retract the rotating band rear edge down to the circumferential edge of the boat tail (g=0), in order to be able at all to arrange the rifling length of the rotating band required for the transmission of spin on the tail, that is on the region supported by the base. In order to ensure the functioning of the entire rotating band with the rotating band rear edge in this position, it is necessary to radially widen the base, coupled with radially squeezing-in of the rotating band in this region. These requirements can be met with the projectile base according to the invention.

Figure 6:
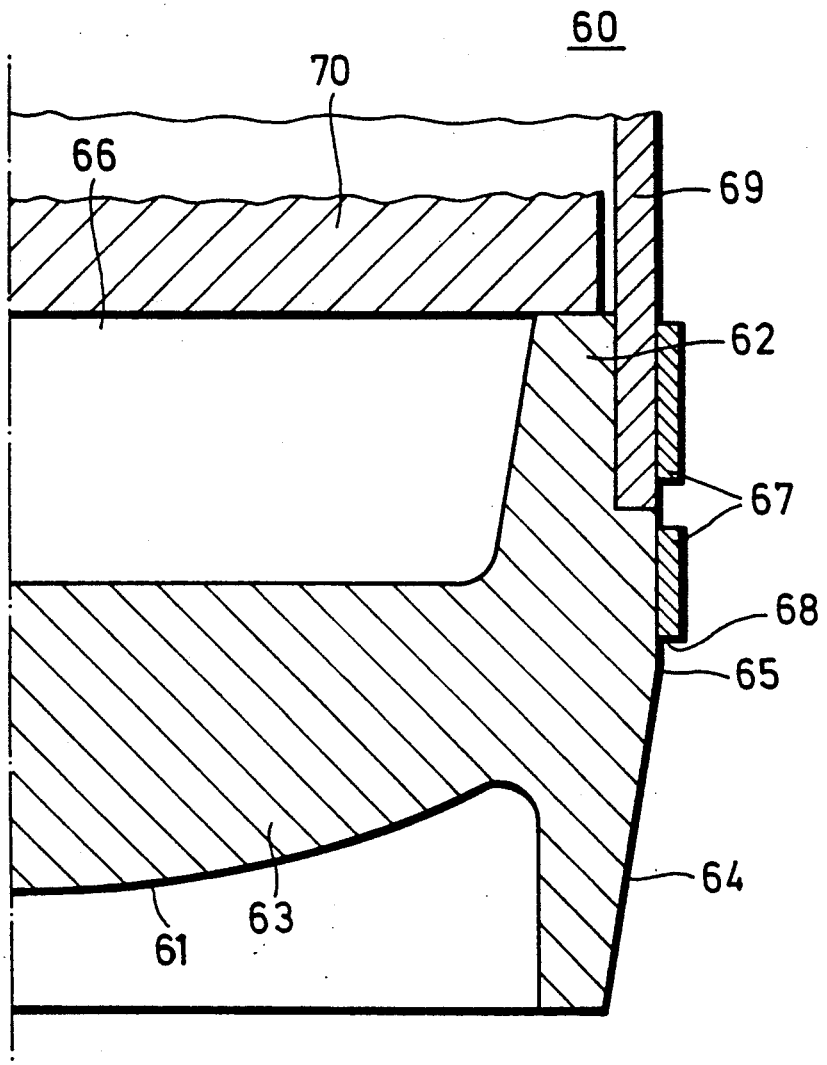
FIG. 6 is a schematic cross-sectional view of part of a carrier projectile including the projectile base according to the invention.

FIG. 6 shows part of a carrier projectile having a thin body. The projectile base is marked 60 and is composed of a base body 62 and a base plate 63. Base body 62 includes a conical tail section 64 whose boat tail edge is marked 65.

One part of a two-part rotating band 67 is seated on base body 62. The cavity for a parachute (not shown) is marked 66. The thin body 69 of the carrier projectile is fastened to projectile base 60. Submunition bodies are disposed in the interior of the carrier projectile. The tail end of such a submunition body is indicated by the reference numeral 70. In a practical embodiment, the base plate 63 includes a curved portion 61 which is curved to have the shape of a portion of a sphere.

We claim:

1. In a carrier projectile, for carrying submunition, comprising a thin walled projectile body which is open at its rear end, a projectile base connected to and closing said rear end of said projectile body, and a rotating band disposed on said projectile base, with said projectile base including a cylindrical base body having a front section with a cylindrical outer surface, a tail section with a conically tapered outer surface, and a base plate, with said rotating band being disposed on said cylindrical outer surface of said base body, with said base plate having a first surface facing a tail end of said projectile base and a second surface facing away from said projectile base tail end, with said first and second surfaces being defined by respective first and second cavities formed in opposite end surfaces of said base body, and with said second cavity having no components disposed therein to support the said base plate or said base body; the improvement wherein said first surface of said base plate is curved and tapers toward the longitudinal axis of the projectile base in a direction toward said projectile base tail end such that said base withstands stresses encountered during firing of said projectile.

2. A projectile according to claim 1, wherein the following relationships apply for the curvature of said first surface of said base plate:

$$1/20D \leqq t \leqq 1/5D$$

$$1/20D \leqq f \leqq 1/5D$$

$$g \geqq 0$$

$$10^\circ \leqq \beta \leqq 40^\circ$$

where

D = caliber of the projectile and base plate;

t = maximum axial depth of curvature of said first surface;

f = axial distance between a rear edge of said rotating band and an outer edge of the curvature;

g = axial distance between said rear edge of said rotating band and a front edge of said conically tapered outer surface of said tail section; and $\beta$ = maximum pitch angle of said curvature of said base plate.

3. A projectile according to claim 1, wherein said first surface of said base plate has a curvature with a shape conforming to that of a portion of a sphere.

4. A projectile according to claim 3, wherein said sphere has a radius R, and the following relationship applies for said radius R:

$$2/3D \leqq R \leqq 3/2D$$

where D is the caliber of the projectile.

5. A projectile according to claim 4, wherein the following applies for an axial distance x between a rear edge of said rotating band and a point of intersection of a circle described by said radius with said outer cylindrical surface of said base body:

$$x \leqq 1/10D$$

with said point of intersection lying in front of or behind said rear edge of said rotating band.

6. A projectile according to claim 1, wherein said first surface of said base plate has a curvature with a conical configuration.

7. A projectile according to claim 6, wherein the following applies for an axial distance x between a rear edge of said rotating band and a point of intersection of a mathematically defined cone containing said first surface with said outer cylindrical surface of said base body:

$$x \leqq 1/10D$$

with said point of intersection being located in either one of two axial directions relative to said rear edge of said rotating band.

8. A projectile according to claim 6, wherein the following applies for a cone angle $\alpha$ of said first surface of said base plate relative to a radial direction of said base:

$$7^\circ \leqq \alpha \leqq 25^\circ.$$

9. A projectile as defined in claim 1 wherein said second surface of said base plate is substantially planar.

* * * * *